US008713756B2

(12) United States Patent
Wu

(10) Patent No.: US 8,713,756 B2
(45) Date of Patent: May 6, 2014

(54) DOOR CLOSER STOPPER

(75) Inventor: Fengqing Wu, Guangzhou (CN)

(73) Assignee: Cmech (Guangzhou) Industrial Ltd. (CN)

( * ) Notice: Subject to any disclaimer, the term of this patent is extended or adjusted under 35 U.S.C. 154(b) by 124 days.

(21) Appl. No.: 13/195,379

(22) Filed: Aug. 1, 2011

(65) Prior Publication Data

US 2012/0260459 A1 Oct. 18, 2012

(30) Foreign Application Priority Data

Apr. 18, 2011 (CN) ..... 2011 1 0096495

(51) Int. Cl.
*E05F 3/02* (2006.01)
*E05F 1/00* (2006.01)

(52) U.S. Cl.
USPC ..... 16/66; 16/49; 16/71; 16/80

(58) Field of Classification Search
USPC ..... 16/49, 51, 58, 57, 66, 63, 64, 65, 71, 16/72, 82, 80, 85
See application file for complete search history.

(56) References Cited

U.S. PATENT DOCUMENTS

| | | | | |
|---|---|---|---|---|
| 2,739,341 | A * | 3/1956 | Malcolm | 16/82 |
| 5,529,148 | A * | 6/1996 | O'Leary | 188/67 |
| 5,630,248 | A * | 5/1997 | Luca | 16/71 |
| 5,832,562 | A * | 11/1998 | Luca | 16/71 |
| 6,634,058 | B1 * | 10/2003 | Lin | 16/66 |
| 7,134,168 | B1 * | 11/2006 | Qing | 16/80 |
| 7,216,400 | B2 * | 5/2007 | Hodson | 16/66 |
| 7,730,579 | B2 * | 6/2010 | Coe | 16/66 |
| 8,443,488 | B2 * | 5/2013 | Zhang | 16/65 |
| 2003/0126716 | A1 * | 7/2003 | Lin | 16/66 |
| 2012/0167340 | A1 * | 7/2012 | Zhang | 16/65 |
| 2012/0260459 | A1 * | 10/2012 | Wu | 16/82 |

FOREIGN PATENT DOCUMENTS

| | | |
|---|---|---|
| CN | 2353851 | 12/1999 |
| CN | 1667226 | 9/2005 |
| CN | 200961402 | 10/2007 |

* cited by examiner

*Primary Examiner* — Emily Morgan
(74) *Attorney, Agent, or Firm* — Schmeiser, Olsen & Watts, LLP

(57) ABSTRACT

The present disclosure discloses a door closer stopper, comprising a housing mounted around a door closer, a finger press block assembly and a stop assembly disposed in the housing. The housing is provided with a slot and an opening; The finger press block assembly comprises a press block and a rotary press block hinged to the slot of the housing, and a positioning mechanism limiting the rotary press block at a position propping a catch plate; The stop assembly comprises the catch plate with a central through hole to allow the pull rod of the door closer to extend therethrough, the catch plate is perpendicular to the pull rod and has a top end in a scope of movement of the rotary press block, the rotary press block can abut against the top end of the catch plate to make the catch plate incline when the rotary press block rotates to a certain position. The present disclosure is overly compact and reasonable in structure, simple and easy to operate, and practical, safe and reliable. The user does not need to replace the original door closer and only needs to additionally install the present disclosure to perform an easy switch between several working states. The door can be positioned and remain an open state at any opening angle, and can quickly resume an auto door closing function. The present disclosure is adapted for various ordinary tubular door closers and has a broad application prospect.

8 Claims, 3 Drawing Sheets

DOOR CLOSER STOPPER

FIELD OF TECHNOLOGY

The present invention relates to a door closer, and particular to a stopper adapted for an ordinary door closer.

BACKGROUND

At present, door closers are generally classified into mechanical door closers, pneumatic door closers and hydraulic door closers, wherein mechanical door closers generally employ an elastic assembly formed by a spring. When an operator pushes a door or window, a drive spring accumulates energy through deformations such as stretching, compression or torsion, and the accumulated energy will be released when the operator moves away from the door or window. A pull rod, driven by the spring, closes the door. However, ordinary mechanical door closers in the prior art cannot be positioned in use and cannot enable the door to remain at a certain opening angle. When articles are transported through the door or many people go through the door in a short period of time, collision between the door and articles or people might occur, thereby causing inconvenience. To solve this problem, some people achieves the positioning by improving the internal structure of the door closer, but the improvement is complicated in structure and assembling. As far as a user is concerned, the improvement requires the user to replace the whole of the original door closer, which increases the costs.

SUMMARY

An object of the present invention is to provide a door closer stopper which is simple in structure, convenient to install and easy to operate, to overcome the shortcomings and drawbacks in the prior art.

To achieve the above object, the present invention is implemented according to the following technical solutions:

A door closer stopper comprises a housing mounted around a door closer, a finger press block assembly and a stop assembly disposed in the housing. The housing is provided with a slot for mounting a finger press block assembly, and an opening allowing a pull rod of the door closer to extend therethrough. The finger press block assembly comprises a press block hinged to the slot of the housing at an uppermost position to allow a user to apply a downward pressing force, a rotary press block being hinged to the slot of the housing and rotating synchronously with the press block, and a positioning mechanism limiting the rotary press block at a position propping a catch plate. The stop assembly comprises the catch plate with a central through hole to allow the pull rod of the door closer to extend therethrough, the catch plate is perpendicular to the pull rod and has a top end in a scope of movement of the rotary press block, the rotary press block abuts against the top end of the catch plate to make the catch plate incline when the rotary press block rotates to a certain position.

The positioning mechanism comprises a first limiting mechanism for limiting a rotation angle of the rotary press block, and a second limiting mechanism enabling the press block remain in a pressed-down state when the press block is pressed down.

The first limiting mechanism comprises: a notch provided at a tail portion of the rotary press block, and a first limiting hub fixed to the slot of the housing, disposed at a position corresponding to the notch and being capable of limiting the rotation angle of the rotary press block.

The second limiting mechanism comprises a second limiting hub and a second elastic return element disposed in the rotary press block, the second limiting hub is mounted in an elongate hole of the rotary press block and is movable towards a tail portion or a head portion of the rotary press block along the elongate hole, the second elastic return element applies a force to the second limiting hub to allow it to abut against the first limiting hub all the time, and the second limiting hub moves below the first limiting hub when the press block is in a pressed-down state.

The finger press block assembly further comprises a dial piece hinged to slot of the housing, the dial piece is connected to the first elastic return element, the first elastic return element applies a force to the dial piece to allow it to rotate counterclockwise, the dial piece abuts against a top end of the catch plate to make the catch plate incline when the dial piece rotates to a certain position.

The press block, the rotary press block and the dial piece are coaxially hinged to the slot of the housing.

The stop assembly comprises a fixing sheet, a return spring and a catch plate which are mounted in turn, central through holes of the three members are coaxial with an opening of the closed end of the housing, the fixing sheet sandwiches the return spring and the catch plate in a gap between the fixing sheet and an inner side of the closed end of the housing.

Two nicks are symmetrically provided on the edge of the central through hole of the catch plate in a horizontal direction.

The fixing sheet is L-shaped and has a raised mounting leg inserted and fixed inside the closed end of the housing.

A cross section of the housing is shaped and sized to match the door closer, an end of the housing is open and this end is provided with a fastener for fastening the stopper to the door closer, the other end of the housing is closed and the centre of this other end is provided with a opening allowing the pull rod of the door closer to extend therethrough.

The present invention is overally compact and reasonable in structure, simple and easy to operate, and practical, safe and reliable. The user does not need to replace the original door closer and only needs to additionally install the present invention to perform an easy switch between several working states. The door can be positioned at any opening angle for a long time and stably remain an open state, and can quickly resume an auto door closing function. The present invention is adapted for various ordinary tubular door closers and has a broad application prospect.

DETAILED DESCRIPTION

Figure 1:
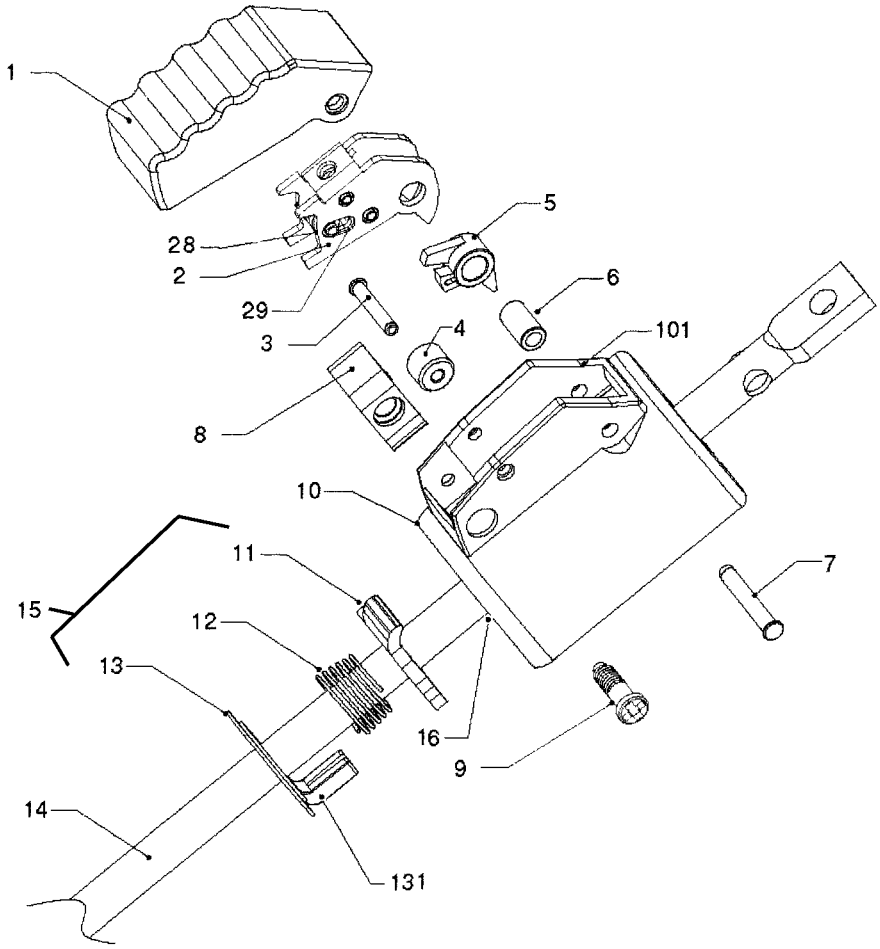
FIG. 1 is an exploded view of the present invention.
Figure 2:
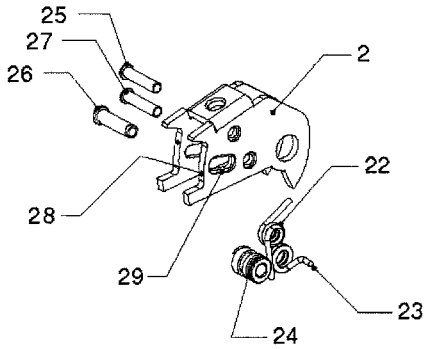
FIG. 2 is a detailed view of the rotary press block 2 at FIG. 1 of the present invention.
Figure 3:
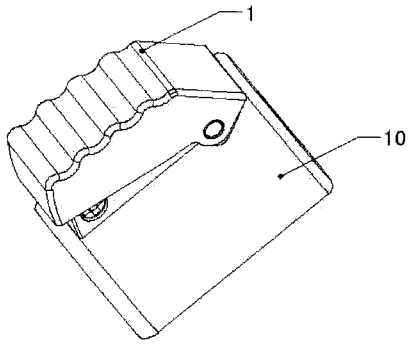
FIGS. 3 and 4 are perspective views of the present invention.

The present invention will be illustrated by describing specific embodiments with reference to the accompanying drawings, but the present invention is not limited to the following embodiments.

As shown in FIGS. 1-4, the present invention provides a door closer stopper comprising a housing, a finger press block assembly and a stop assembly.

A housing 10 is used to mount the whole stopper around an ordinary door closer, so a cross section of the housing is sized to match the door closer. In the example, the housing 10 has a circular cross section and is sized to right around a cylindrical door closer. The housing is open at one end, and closed at the other end. At a center of the closed end of the housing is provided with an opening 102 allowing a door closer pull rod 14 to pass therethrough. The housing 10 is provided with a longitudinal hollowed slot 101 for fixing the finger press block assembly.

After the housing 10 is attached around a front end of the door closer, it can be fixed to the door closer via a fastener. In the example, a fastener block 8 is disposed on a side of the hollowed slot 101 adjacent to the open end 16 of the housing. The fastener block 8 is fixed to the hollowed slot 101 via a bolt 9, and a bottom portion of the fastener block 8 is a curved arcuate friction surface. After the housing 10 is attached around the front end of the door closer, the fastener block 8 is screwed tight and fixed, the bottom portion thereof can abut closely against the housing of the door closer, thereby fixing the stopper and the door closer together. The installation is very convenient. Fasteners in other forms such as a screw can be used in place of the bolt so long as the bottom portion of the fastener can tightly press the housing of the door closer.

The finger press block assembly comprises a press block 1, a rotary press block 2, a dial piece 5 and a positioning mechanism. The press block 1, the rotary press block 2 and the dial piece 5 are coaxially hinged to the hollowed slot 101. The press block 1 has a substantially "n" shaped cross section, covers the hollowed slot 101 and is hinged on a sidewall of the hollowed slot 101 via a pin 7. The rotary press block 2 is located below the press block 1, and its upper surface contacts an inner top of the press block 1. The rotary press block 2 and the press block 1 rotate synchronously. The rotary press block 2 functions to enable a catch plate 11 of the stop assembly described hereunder to incline when it rotates to a certain position, thereby locking the pull rod 14. However, since the catch plate 11 and the pull rod 14 are both made of a rigid material and the pull rod 14 is subjected to a huge pull-back force of the door closer, long-term stable locking usually cannot be ensured only in the way that the press block 1 is pressed to allow the rotary press block 2 to prop up the catch plate 11 to lock the pull rod 14. Therefore, the present invention additionally provides a positioning mechanism for limiting the rotary press block 2 to a position for propping up the catch plate 11.

A head portion of the rotary press block 2 bends downwardly, and a tail portion of the rotary press block 2 is provided with a notch 28 which is formed as having an upper flange and a lower flange. The position corresponding to the notch 28 of the tail portion of the rotary press block 2 is provided with a first limiting hub 4, and the first limiting hub 4 is connected to sidewalls of the hollowed slot 101 via a pin 3. When the rotary press block 2 rotates, the upper flange and the lower flange of its notch 28 are blocked by the first limiting hub 4 so as to form a first limiting mechanism for limiting an rotation angle of the rotary press block 2. The cooperation between the notch 28 at the tail portion of the rotary press block 2 and the first limiting hub 4 enables the rotary press block 2 to rotate to a proper angle in a stopped state (i.e., the upper flange is blocked by the first limiting hub 4) and a locked state (the lower flange is blocked by the first limiting hub 4) of the stopper and to prop up a top end of the catch plate 11 to make the catch plate 11 incline so that a edge of a central through hole thereof closely abuts against a surface of the pull rod 14. The rotary press plate 2 is separated from the top end of the catch plate 11 when the stopper is in a loosened state.

The rotary press block 2 is further provided with a second limiting mechanism for keeping the press block 1 in a pressed-down state after the press block 1 is pressed down. The second limiting mechanism comprises a second limiting hub 24 and a second elastic return element 22. The second limiting hub 24 is movably mounted in the rotary press block 2 via a pin 26. A hole for mounting the pin 26 is in an elongate shape, so the second limiting hub 24 can move towards the tail portion or head portion of the rotary press block 2 along the elongate hole 29 via the pin 26. The second elastic return element 22 employs a torsion spring which is fixed in the rotary press block 2 via the pin 25. One end of the torsion spring abuts against the rotary press block 2, and the other end thereof abuts against the second limiting hub 24, applying a force to the second limiting hub 24 to allow it to abut against the first limiting hub 4 all the time. The second limiting hub 24 moves below the first limiting hub 4 when the press block 1 is in a pressed-down state. At this time, since the first limiting hub 4 blocks the second limiting hub 24, the rotary press block is maintained at a position propping up the catch plate 11 and cannot rotate clockwise, and the press block 1 cannot bounce up automatically. The first limiting hub 4 and the second limiting hub 24 can be shaped in other alternative shapes so long as contact surfaces of the two hubs are arcuate surfaces to facilitate relative movement.

Since the rotation angle of the rotary press block 2 must be accurately controlled, higher requirements will be imposed on dimension deviations and mounting precision of parts. In a preferred solution of the embodiment, by providing the finger press block assembly additionally with a dial piece 5 and a first elastic return element 23, the dimension deviations and mounting precision of parts of the finger press block assembly are reduced since a elastic force acts to enable them to remain a propping-up state in a certain angular scope. Meanwhile, loosening between the pull rod 14 and the finger press block assembly caused when the door is subjected to vibration or slight collision will be prevented due to presence of resilience and anti-shock and buffer function. The dial piece 5 is located in the rotary press block 2. The dial piece 5 and the rotary press block 2, running through a sleeve 6 which runs through aligned mounting holes of the dial piece 5 and the rotary press block 2, are articulated to the sidewalls of the hollowed slot 101 via a pin 7. The dial piece 5 and the rotary press block 2 are substantially the same in terms of an orientation, position and height of their respective head portions. The only difference is that the head portion of the dial piece 5 protrudes slightly more forwardly than the head portion of the rotary press block 2, and rotation angles thereof slightly differ in different use states. The dial piece 5 is connected to the first elastic return element 23, the first elastic return element 23 employs a torsion spring which is fixed in the rotary press block 2 via a pin 27. One end of the torsion spring abuts against the rotary press block 2 and the other end thereof is connected to one side of a tail portion of the dial piece 5, applying a force to the dial piece 5 to make the dial piece 5 rotate counterclockwise to make it remain in a forwardly propping state.

Figure 4:
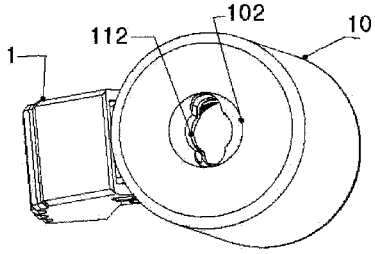
Figure 5:
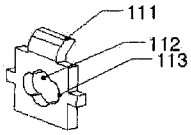
FIG. 5 is a schematic view showing the structure of a catch plate of the present invention.

The stop assembly comprises a fixing sheet 13, a return spring 12 and a catch plate 11 which are mounted in turn. Central through holes of the three members are coaxial with an opening of the closed end of the housing 10. The door closer pull rod 14 can run through the central through holes of the three members and then extend out of with the opening of the housing 10. The fixing sheet 13 is L-shaped and has a raised mounting leg inserted and fixed inside the closed end of the housing 10 so as to sandwich the return spring 12 and the catch plate 11 in a gap between the fixing sheet 13 and an inner side of the closed end of the housing 10. A top end 111 of the catch plate 11 slight curves forwardly and is located in a scope of movement of the respective head portions of the dial piece 5 and the rotary press block 2. When the dial block 5 and the rotary press block 2 rotate to a certain position, they can abut against the top end of the catch plate 11 and make it incline so that the edge of the central through hole of the catch plate 11 closely abuts against the pull rod 14, thereby achieve the stopping. In order to allow the catch plate 11 to better abut against the door closer pull rod 14, two nicks 113 are symmetrically provided on the edge of the central through hole 112 of the catch plate 11 in a horizontal direction, as shown in FIG. 4. The return spring 12 employs a compression spring which one end abuts against the fixing sheet 13 and the other end abuts against the catch plate 11, applying the catch plate a force towards the closed end of the housing 10.

Figure 6:
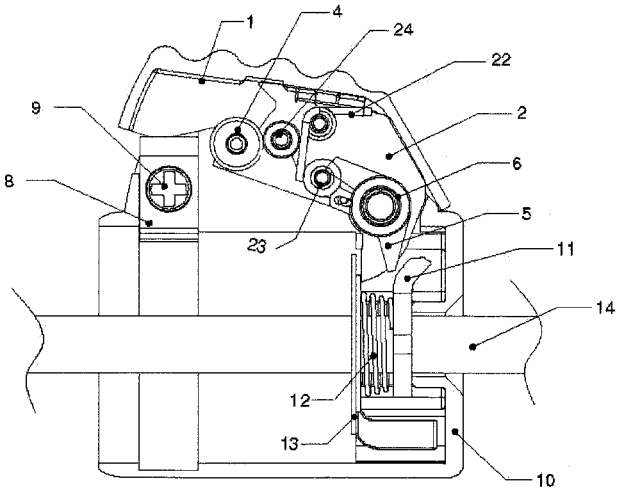
FIGS. 6 to 8 are respectively a cross-sectional view of an internal structure of the present invention in a loosened state, a stopped state and a locked state.

Operating Principles:

As shown in FIG. 6, the stopper is in a loosened state (a normal state). At this time, the rotary press block 2 and the dial piece 5 of the finger press block assembly do not contact the catch plate 11 of the stop assembly or only touch the catch plate 11 of the stop assembly without force transfer. The catch plate 11 is only subjected to a force of the return spring 12 so that it is forced to closely abut against the inner side of the closed end of the housing 10 and become perpendicular to the pull rod 14. Therefore, the pull rod 14 can freely pass the central through hole of the catch plate 11. At this time, the stopper does not act upon the door closer, and the action of the pull rod 14 is controlled by the door closer itself.

Figure 7:
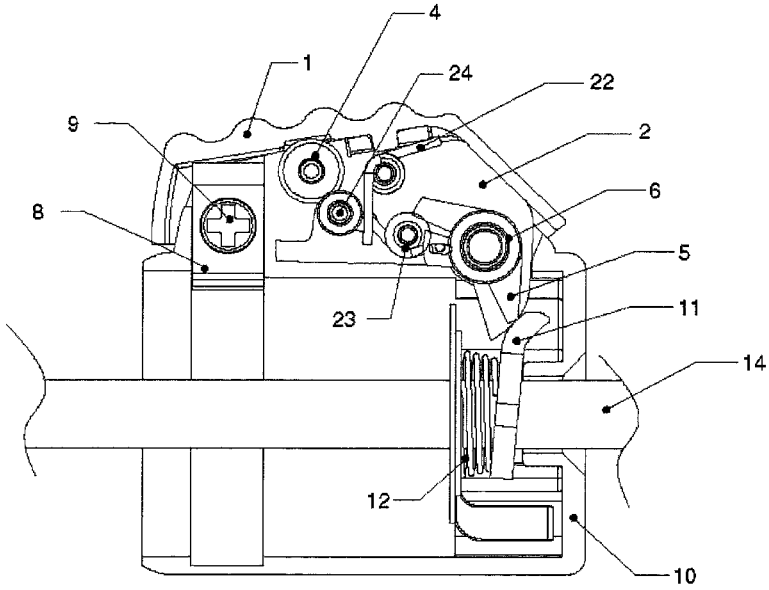

When the door needs to be opened and fixed at a certain angle, first, the press block 1 is pressed (rotated counterclockwise) to bring the rotary press block 2 to rotate synchronously counterclockwise until the upper flange of the notch 28 at the tail portion of the rotary press block 2 is blocked by the first limiting hub 4, whereupon the second limiting hub 24 is pushed by the force of the second elastic return element 22 to below the first limiting hub 4 along the elongate hole 29, thereby positioning and preventing the press block 1 from automatically bouncing up. The catch plate 11 originally closely abuts against the inner side of the closed end of the housing 10. But the rotary press block 2 rotates counterclockwise, and its head portion abuts against the top end of the catch plate 11, so the catch plate 11 is enabled to incline some extent and the edge of the central through hole of the catch plate 11 abuts against the surface of the pull rod 14. The pull rod 14 cannot be completely locked only by virtue of the propping force of the rotary press block 2. At this time, the stopper is in a stopped state as shown in FIG. 7.

Figure 8:
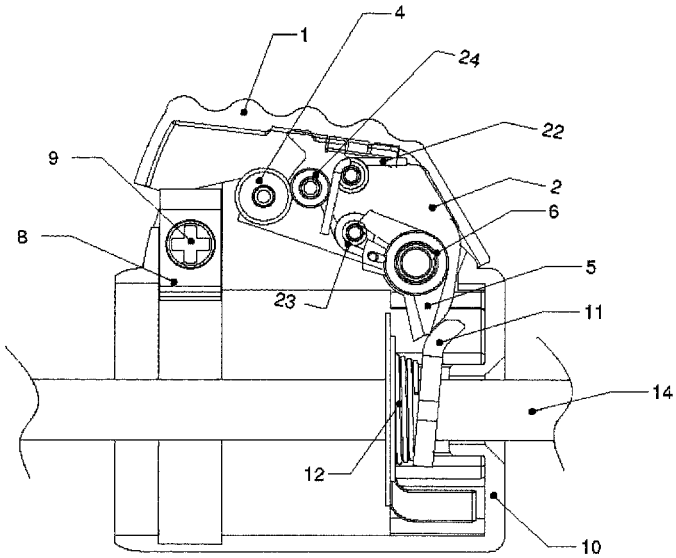

Then the door is pushed open, the pull rod 14 is pulled outwardly (whereupon the catch plate 11 remains stationary in the inclined state because of the propping up of the rotary press block 2), and the door closer allows the pull rod 14 to retract after the hand loses hold of the door. Since the edge of the central through hole of the catch plate 11 abuts against the surface of the pull rod 14, the pull rod 14 brings the inclined catch plate 11 to move backward together until the catch plate 11 completely compresses the return spring 12. During movement of the catch plate 11, its top end abuts against the head portion of the rotary press block 2 and brings the rotary press block 2 and the dial piece 5 to rotate clockwise, and the press block 1 is bounced up until the lower flange of the notch 28 at the tail portion of the rotary press block 2 is blocked by the first limiting hub 4. Due the second return spring 23 applies a force to the dial piece 5 to make it rotate counterclockwise, the head portion of the dial piece 5 is enabled to keep propping up the top end of the catch plate 11. The catch plate 11 is subjected to a huge pull-back force of the pull rod 14 on the one hand, and on the other hand, its head portion is subjected to a forwardly propping force of the finger press block assembly. Therefore, the more the pull rod 14 retracts, the larger the inclination angle of the catch plate 11 becomes until the pull rod 14 is completely locked. Furthermore, the longer the time is, the firmer the locking is, whereby the problem with prior art products are solved thoroughly. At this time, the stopper is in a locked state as shown in FIG. 8, and the door remains in an opened state. In order to achieve the state, the pull rod 14 should be pulled out not less than 10 mm. The pull rod 14 can be locked at any pulled-out distance, thereby achieving position of the door at any opening angle.

When the door needs to be closed, the door is further pushed in the opening direction, the pull rod 14 is pulled outward (the pulled-out distance should not be less than 10 mm) and brings the catch plate 11 to move outwardly together until the catch plate 11 abuts against the inner side of the closed end of the housing 10. Meanwhile, due to the force from the return spring 12, the catch plate 11 resumes a vertical state, and the edge of the central through hole of the catch plate 11 does not closely abuts against the surface of the pull rod 14 any longer. At this time, the stopper resumes the loosened state as shown in FIG. 6. The action of the pull rod 14 is controlled by the door closer itself to perform the door closing function.

The present invention is not limited to the above embodiments. If various modification or variations to the present invention do not depart from the spirit and scope of the present invention, the present invention also intends to contain the various modifications and variations if they fall within the scope of claims of the present invention and equivalent technologies.

What is claimed is:

1. A door closer stopper comprising:

a housing mounted around a door closer, being provided with a slot connected to a finger press block assembly, and an opening allowing a pull rod of the door closer to extend therethrough;

the finger press block assembly comprising a press block hinged to the slot of the housing at an uppermost position to allow a user to apply a downward pressing force, a rotary press block hinged to the slot of the housing and rotating synchronously with the press block, and a positioning mechanism limiting said rotary press block at a position propping a catch plate; and a stop assembly disposed in the housing, comprising the catch plate with a central through hole to allow the pull rod of the door closer to extend therethrough, the catch plate is perpendicular to the pull rod and has a top end, the rotary press block abuts against the top end of the catch plate to make the catch plate incline when the rotary press block rotates to a certain position;

wherein said positioning mechanism comprises a first limiting mechanism for limiting a rotation angle of the rotary press block, and a second limiting mechanism enabling the press block to remain in a pressed-down state when the press block is pressed down;

wherein said first limiting mechanism comprises a notch provided at a tail portion of the rotary press block, and a first limiting hub fixed to the slot of the housing, disposed at a position corresponding to said notch and being capable of limiting the rotation angle of the rotary press block;

wherein said second limiting mechanism comprises a second limiting hub and a second elastic return element disposed in the rotary press block, said second limiting hub is mounted in an elongate hole of the rotary press block and is movable towards a tail portion or a head portion of the rotary press block along the elongate hole, said second elastic return element applies a force to the second limiting hub to allow it to abut against the first limiting hub all the time, and said second limiting hub moves below the first limiting hub when the press block is in a pressed-down state.

2. The door closer stopper according to claim 1, wherein said finger press block assembly further comprises a dial piece hinged to slot of the housing, the dial piece is connected to a first elastic return element, the first elastic return element applies a force to the dial piece to allow it to rotate counterclockwise, the dial piece abuts against a top end of the catch plate to make the catch plate incline when the dial piece rotates to a certain position.

3. The door closer stopper according to claim 2, wherein said press block, said rotary press block and said dial piece are coaxially hinged to the slot of the housing.

4. The door closer stopper according to claim 1, wherein said stop assembly comprises a fixing sheet, a return spring and the catch plate which are mounted in order, central through holes of the three members are coaxial with an opening of the closed end of the housing, the fixing sheet sandwiches the return spring and the catch plate in a gap between the fixing sheet and an inner side of the closed end of the housing.

5. The door closer stopper according to claim 1, wherein two nicks are symmetrically provided on an edge of the central through hole of the catch plate in a horizontal direction.

6. The door closer stopper according to claim 4, wherein said fixing sheet is L-shaped and has a raised mounting leg inserted and fixed inside the closed end of the housing.

7. The door closer stopper according to claim 1, wherein a cross section of said housing is shaped and sized to match the door closer, an end of the housing is open and this end is provided with a fastener for fastening the stopper to the door closer, the other end of the housing is closed and the center of this other end is provided with an opening allowing the pull rod of the door closer to extend therethrough.

8. A door closer stopper comprising:

a housing mounted around a door closer, being provided with a slot connected to a finger press block assembly, and an opening allowing a pull rod of the door closer to extend therethrough;

the finger press block assembly comprising a press block hinged to the slot of the housing at an uppermost position to allow a user to apply a downward pressing force, a rotary press block hinged to the slot of the housing and rotating synchronously with the press block, and a positioning mechanism limiting said rotary press block at a position propping a catch plate; and a stop assembly disposed in the housing, comprising the catch plate with a central through hole to allow the pull rod of the door closer to extend therethrough, the catch plate is perpendicular to the pull rod and has a top end, the rotary press block abuts against the top end of the catch plate to make the catch plate incline when the rotary press block rotates to a certain position;

wherein said finger press block assembly further comprises a dial piece hinged to slot of the housing, the dial piece is connected to a first elastic return element, the first elastic return element applies a force to the dial piece to allow it to rotate counterclockwise, the dial piece abuts against a top end of the catch plate to make the catch plate incline when the dial piece rotates to a certain position;

wherein said press block, said rotary press block and said dial piece are coaxially hinged to the slot of the housing.

* * * * *

UNITED STATES PATENT AND TRADEMARK OFFICE

CERTIFICATE OF CORRECTION

PATENT NO. : 8,713,756 B2
APPLICATION NO. : 13/195379
DATED : May 6, 2014
INVENTOR(S) : Fengqing Wu It is certified that error appears in the above-identified patent and that said Letters Patent is hereby corrected as shown below:

In the Specification:

COLUMN 5

Line 2, after "leg", insert -- 131 --

Line 17, delete "4" and insert -- 5 --

Signed and Sealed this
Fourteenth Day of October, 2014

Michelle K. Lee

Michelle K. Lee
*Deputy Director of the United States Patent and Trademark Office*